US005156510A

United States Patent [19]

Uehara

[11] Patent Number: 5,156,510

[45] Date of Patent: Oct. 20, 1992

[54] BOOKBINDING COVER

[75] Inventor: Haruo Uehara, Yokohama, Japan

[73] Assignee: Canon Kabushiki Kaisha, Tokyo, Japan

[21] Appl. No.: 622,500

[22] Filed: Dec. 5, 1990

[30] Foreign Application Priority Data

Dec. 5, 1989 [JP] Japan ..... 1-314229

[51] Int. Cl.[5] ..... B42C 9/00

[52] U.S. Cl. ..... 412/8; 412/37; 156/325; 281/21.1

[58] Field of Search ..... 412/6, 8, 37; 156/60, 156/325; 281/21.1

[56] References Cited

U.S. PATENT DOCUMENTS

| | | | |
|---|---|---|---|
| 3,837,994 | 9/1974 | Flanagan et al. | 412/8 X |
| 3,847,718 | 11/1974 | Watson | 161/39 |
| 4,289,330 | 9/1981 | Wiermanski | 281/21 R |
| 4,749,427 | 6/1988 | Pitts et al. | 412/8 X |
| 4,750,956 | 6/1988 | Malachowski | 412/8 X |
| 4,762,341 | 8/1988 | Rabuse | 412/8 |

FOREIGN PATENT DOCUMENTS

| | | |
|---|---|---|
| 59-017746 | 2/1984 | Japan . |
| 61-050469 | 4/1986 | Japan . |
| 61-180752 | 11/1986 | Japan . |

*Primary Examiner*—Timothy V. Eley
*Assistant Examiner*—Willmon Fridie, Jr.
*Attorney, Agent, or Firm*—Fitzpatrick, Cella, Harper & Scinto

[57] ABSTRACT

A bookbinding cover has a front cover, a rear cover and a back plate which is connected to the front and rear cover, and a hot-melt adhesive layer applied to the back plate. The adhesive layer has a multi-layer structure, and the softening point of each of the layers which form the adhesive layer decreases with an increase in distance from the back plate. The bookbinding cover permits simple bookbinding with sufficient strength for a short time.

11 Claims, 1 Drawing Sheet

BOOKBINDING COVER

BACKGROUND OF THE INVENTION

1. Field of the Invention

The present invention relates to a bookbinding cover with an adhesive which is used for simply binding the documents produced by printing or copying at offices or homes.

2. Description of the Related art

An example of such bookbinding covers is disclosed in Japanese Patent Publication No. 61-4675 in which a back plate has an adhesive layer, and each of a front cover and a rear cover has a portion on the inside thereof which is near the back plate and to which an adhesive is applied for limiting the position of sheets of paper to be bound and for providing adhesive reinforcing.

Japanese Utility Model Laid-Open No. 59-17746 discloses the structure of a bookbinding resin sheet in which a nonwoven fabric, paper, woven fabric or the like used as a base material is impregnated with a so-called hot-melt adhesive, and an adhesive layer is also provided on the front and rear sides of the base material. The sheet formed can be used as a bookbinding sheet having a bound portion with improved strength and durability.

In Japanese Utility Model Laid-Open No. 61-50469, capsules containing a liquid adhesive are placed on tape-like base paper and are broken by employing heat and pressure in order to bind sheets of paper which form the pages of a book.

Japanese Utility Model Laid-Open No. 61-180752 discloses a design in which kerfs are provided in the hot-melt adhesive provided on the inside of a back plate in the lengthwise direction thereof so that the adhesive portion can be folded corresponding to the amount (thickness) of sheets to be bound.

Further, Japanese Patent Laid-Open No. 48-53821 discloses a cover with an adhesive.

Although all the examples of prior art disclose the arrangement and shape of an adhesive, they disclose no bonding ability of the adhesive used.

An adhesive layer in a back plate is generally required to have sufficient strength because it is repeatedly bent when the book is opened and closed.

On the other hand, hot-melt adhesives are effective in bookbinding from the viewpoints of the easiness and speed of adhesion, and hot-melt adhesives having appropriately low heat-melting temperatures are particularly effective. Namely, since hot-melt adhesives are melted by heating and solidified by cooling in order to complete bonding, they are suitable for simple bookbinding. In addition, because hot-melt adhesives having low heat-melting temperatures can be made molten with low heat energy, i.e., at relatively low heating temperatures, the heating time required for producing an adhesive state is short. Since the time required for cooling and solidification in order to complete adhesion is also relatively short, such hot-melt adhesives have useful properties.

Examples of methods employed for decreasing the heat-melting temperatures of hot-melt adhesives include a method of decreasing the molecular weight of the material used, a method of mixing a component having a low molecular weight and the like. However, all the methods bring about decreases in mechanical strength of the adhesive layers formed and thus produce results which are contrary to the necessary conditions for bookbinding in which an important factor is the flexural strength of the bonded portion in the back plate.

SUMMARY OF THE INVENTION

The present invention has been achieved in consideration of the above situation, and it is an object of the present invention to provide a bookbinding cover which has excellent durability and which ensures bookbinding in a short time.

In accordance with one aspect of the invention, a bookbinding cover comprises a bookbinding sheet having a front cover, a rear cover and a back plate, with the back plate having an inside portion and an outside portion and being connected to the front and rear cover. A hot melt adhesive is applied to the inside portion of the back plate, with the adhesive having a multi-layer structure and a softening point of each of the layers decreasing with an increase in distance from the back plate.

In accordance with another aspect of the invention, a bookbinding method for forming a book from a bookbinding cover having a front cover, a rear cover and a back plate, comprises the steps of applying a first adhesive layer to an inside portion of the back plate, and applying a second adhesive layer on the first adhesive layer. The first adhesive layer has a first softening point, and the second adhesive layer has a second softening point which is lower than the first softening point. A plurality of page forming sheets are placed in contact with the second adhesive layer, and the back plate is heated to a temperature which softens the second adhesive layer but not the first adhesive layer. The plurality of sheets are pressed into the softened second adhesive layer to form the book.

The present invention enables bookbinding with a sufficient level of mechanical strength for a short time.

DETAILED DESCRIPTION OF THE PREFERRED EMBODIMENTS

Figure 1:
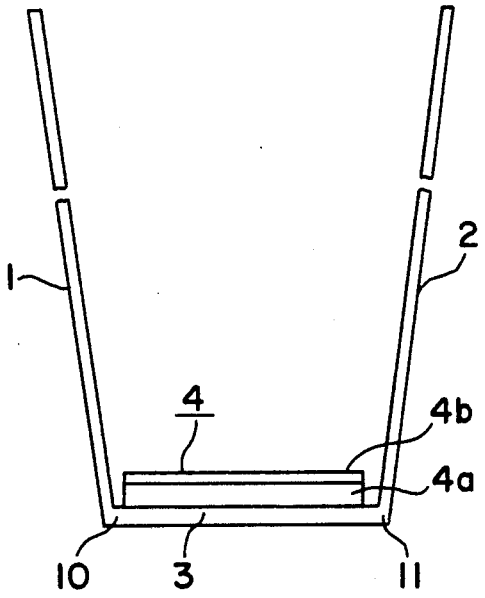
FIG. 1 is a plan view of a bookbinding cover in accordance with an embodiment of the present invention.

As shown in FIG. 1, a bookbinding cover of the present invention comprises a front cover 1, a rear cover 2 and a back plate 3, all of which are connected to each other at the ends thereof, and an adhesive layer 4 applied to the back plate 3. The front cover 1 and the rear cover 2 are pivotally provided on the back plate 3 through connecting portions 10, 11, respectively. Such a bookbinding cover having the front cover 1, the rear cover 2 and the back plate 3 can be formed by, for example, folding a sheet of thick paper at portions corresponding to the connecting portions 10, 11.

The adhesive layer 4 has a hot-melt adhesive which is applied to the inside (the side on which, the pages, are arranged) of the back plate 3.

Figure 2:
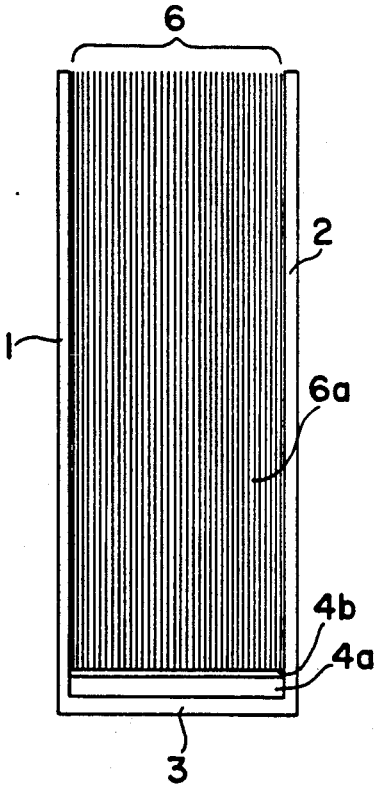
FIG. 2 is a plan view of a book bound by using the bookbinding cover shown in FIG. 1.

During bookbinding using the bookbinding cover of the present invention, as shown in FIG. 2, the adhesive layer 4 is heated and melted by heating the outside of the back plate 3 for a predetermined time while pressing one end of a bundle 6 of sheets of paper 6*a*, which form pages of the book and are put in layers, on the adhesive layer 4. By cooling the adhesive layer after the completion of heating, the sheets of paper 6a are strongly bonded to the adhesive layer 4 to form a book.

In the present invention, the adhesive layer 4 comprises a laminate of a plurality of adhesive layers having different softening points. The softening point of each of the adhesive layers which form the adhesive layer 4 gradually decreases from the back plate side. FIG. 1 shows as an example of the adhesive layer 4 a double layer structure comprising a first adhesive layer 4a (lower layer), which is bonded to the inside of the back plate 3, and a second adhesive layer 4b (upper layer), which is applied to the surface of the first layer 4a. In this case, the second adhesive layer 4b has a softening point lower than that of the first adhesive layer 4a.

In this way, the bookbinding cover of the present invention has the adhesive layer 4 comprising a laminate of a plurality of adhesive layers with a portion of the adhesive layer 4a nearer to the back plate 3, having a higher softening point. The portion of the adhesive layer 4a, which is nearer to the back plate 3, thus has higher mechanical strength so that the sheets of paper 6a are not separated from the adhesive layer 4b even if the front cover 1 or the rear cover 2 is repeatedly opened and closed.

On the other hand, since a portion of the adhesive layer 4b further from the back plate 3, has a lower softening point, the adhesive layer is melted by heating at a relatively low temperature so that the bundle 6 of sheets of paper can be rapidly and securely bonded to the adhesive layer 4b with low energy.

Namely, in the adhesive layer of the present invention, the durability in the portion nearer to the back plate is improved, and the bundle 6 can be rapidly and securely bonded with low energy to a portion of the adhesive layer 4b which is further from the back plate 3. It is therefore sufficient that a layer of the adhesive layer 4b which is closer to the pages, has strength enough to hold and fix the bundle 6. That layer need not have properties such as mechanical strength, flexibility and the like, which are required for the book bound. During binding, therefore, only the layer closer to the pages, which layer has a relatively small thickness (the thickness is described below), i.e., a small thermal capacity, may be softened. As a result, the heat energy required for binding is decreased, and the time required for heating is also decreased, in cooperation with the low softening point. As described above, the bookbinding cover of the present invention therefore enables a decrease in the time for required cooling and solidification and thus bookbinding with low energy for an extremely short time.

In the bookbinding cover having the adhesive layer 4 with a double layer structure, as shown in FIG. 1, a first adhesive layer 4a has a relatively high softening point and strength sufficient to resist mechanical fracture, and a second adhesive layer 4b has a relatively low softening point and is heated and melted at a relatively low temperature for a relatively short time during bonding so that the end of the bundle 6 is appropriately wetted and completely bonded without any failure during the subsequent cooling process.

The highest softening point in the adhesive layer 4 is preferably 100° C. or more. In practical use, the highest softening point is 100° C. to 200° C., preferably 120° C. to 180° C. Of the adhesive layers which form the adhesive layer 4, a layer having a higher softening point, i.e., an adhesive layer 4a near to the back plate 3, basically need not be heated and melted during bookbinding. A material for the layer 4a near to the back plate 3 and a thickness thereof may be selected in consideration of mechanical strength sufficient to resist practical use and flexibility.

Of the adhesive layers which form the adhesive layer 4, a layer 4b having a lower softening point, i.e., an adhesive layer further from the back layer 3, preferably has as low a softening point as possible in view of the heat energy required for bookbinding. However, in practical use, the softening point must be determined in consideration of not only the heat efficiency during bookbinding but also penetration of the adhesive layer into the sheets of paper, mechanical strength and so on. Namely, when an attempt is made to decrease the softening point of an adhesive layer, a material having a low molecular weight is used, or a material having a low molecular weight is contained in the adhesive layer. The adhesive layer having a low softening point easily penetrates into the bundle to be bonded and produces stains in the book bound if the adhesive layer significantly penetrates. In addition, an adhesive layer having a low molecular weight generally has a tendency to have a small adhesive force. In this point, a material for the adhesive layer having a lower softening point must be selected in consideration of strength sufficient to resist practical use. A portion having the lowest softening point therefore has a softening point of 50° to 90° C. and preferably 60° to 80° C.

In the present invention, the softening point was measured by the ring and ball softening point measuring method defined by "Hot-Melt Adhesive Test Method JAI 7-1980" of Japan Adhesive Industrial Standard.

The total thickness of the adhesive layer 4 is 0.5 to 3.0 mm, preferably 0.6 to 2.5 mm. The thickness of each of the layers which form the adhesive layer 4 is 0.1 to 2.0 mm and preferably 0.3 to 1.5 mm. If the sheets of paper 6a are bonded regardless of mechanical strength, the thickness of the adhesive layer can be significantly decreased. Namely, the thickness of a portion (an adhesive layer having a lower softening point) of the adhesive layer 4b, which is required to have the ability to securely bond the sheets of paper 6a rather than mechanical strength, can be decreased. The thickness of each of the layers which form the adhesive layer 4 can be gradually decreased with an increase in the distance from the back plate 3. When the adhesive layer 4 has a double layer structure, as shown in FIG. 1, the second adhesive layer may have a thickness sufficient to uniformly wet the end of the bundle 6 to be bonded and maintain the adhesion to the first adhesive layer while holding the bundle 6 after cooling.

Any conventional known hot-melt adhesives can be used in each of the layers which form the adhesive layer 4. Examples of materials that can be used as the adhesive layer include hot-melt resins each having a desired softening point and mixtures of hot-melt resins and rosin, rosin derivatives or various plasticizers added to the resins for the purpose of providing adhesion or adjusting the softening points. A mixture containing a hot-melt resin or the above mixture and one of various kinks of wax added for the purpose of adjusting viscosity or fluidity can be also used as the adhesive layer. The adhesive layer may contain an appropriate amount of inorganic substance such as clay, talc or the like, which is added for providing the adhesive layer with mechanical strength. If required, the adhesive layer may contain an antioxidant and various pigments.

Examples of hot-melt adhesives include ethylene-vinyl acetate copolymers, polyamide resins, polyolefin resins, polyester resins and the like, all of which can be used singly or in mixture of two or more.

Examples of wax include vegetable wax such as carnauba wax, candelilla wax, rice wax, Japanese wax and the like, mineral wax such as ceresin wax, montan wax and the like, petroleum wax such as paraffin wax, microcrystalline wax and the like, polyethylene wax, Fischer-Tropsch wax and the like, all of which can be used singly or in mixture of two or more.

The mixing ratio of the materials which form the adhesive layer 4 is not limited so far as a desired softening point is obtained. In a preferred example of mixing ratios, for example, each of the layers which form the adhesive layer 4 contains 30 to 70% by weight of hot-melt resin, 10 to 50% by weight of rosin, rosin derivative or one of various plasticizers, 15 to 20% by weight of one of various wax, and if required, an antioxidant, a filler, one of various pigments and the like.

The softening point of the adhesive layer depends much on the molecular weight of the material used. If the molecular weight is low, the softening point is low, while if the molecular weight is high, the softening point is high. Thus the softening point can be easily adjusted by adjusting the molecular weight of the material used.

The adhesive layer 4 may be formed by applying a desired hot-melt adhesive to the inside of the back plate 3 by using an application means such a an applicator or the like. The first adhesive layer **4*a* is first applied by using an applicator having a portion for heat-melting the hot-melt adhesive and a nozzle or roller portion for applying the hot-melt adhesive to the inside of the back plate. After the first adhesive layer has been solidified, the second adhesive layer is applied to the first adhesive layer 4*b***. If third, fourth, . . . layers are applied, the application is repeated the number of times corresponding to the number of the adhesive layers, and all of the layers may be then cooled.

When the bundle 6 is bonded to the bookbinding cover formed in accordance with the present invention, as described above, the bundle 6 is inserted into the bookbinding cover in such a manner that it stands on the adhesive layer of the back plate 3. The back plate portion is then heated, for example, at 120° to 130° C. for about 20 to 40 seconds (the heating temperature and the heating time are adjusted considering the thickness of the back plate) by using heating means (for example, a hot plate) while pressing the end of the bundle 6, at which the ends of the sheets of paper are arranged, on the adhesive layer 4, and then cooled by allowing it stand to form a book.

Many bookbinding machines which are capable of bookbinding by heating the back plate of a bookbinding cover are now commercially available.

The present invention exhibits an excellent results regardless of the type of the sheets of paper **6*a* used which form the pages of a book. However, it is a fact that the adhesion between the adhesive layer 4 and the sheets 6*a* slightly depends upon the the degree of penetration of the melted adhesive layer into the sheets of paper 6*a* or between the respective sheets of paper 6*a*. In addition, if the melted adhesive layer excessively penetrates into the sheets of paper 6*a* or between the sheets of paper 6*a*, the melted adhesive layer produces stains which are unsuitable for practical use. In order to further improve the present invention, it is preferable to consider the physical properties of the sheets of paper 6*a*, particularly, the density and smoothness of each sheet of paper 6*a***. Namely, each of the sheets of paper used in the bookbinding cover of the present invention preferably has a density of $0.750 \pm 0.150$ g/cm$^3$ and smoothness of 10 to 100 seconds and more preferably 15 to 80 seconds.

The density was measured by JIS-P-8118 "Method of Measuring Thickness and Density of Paper and Paperboard", and the smoothness was measured by JIS-P-8119 "Method of Testing Smoothness of Paper and Paperboard by Beck Testing Machine".

The present invention is described in detail below with reference to examples.

EXAMPLES 1 to 5

The first layer **4*a* and the second layer 4*b*, both of which are shown in FIG. 1, were formed by applying ethylene-vinyl acetate hot-melt adhesive bond BC603 (softening point, 190° C.) manufactured by Konishi Co. Ltd., and ethylene-vinyl acetate hot-melt adhesive K2982 (softening point, 81° C.) manufactured by Asahi Chemical Co. Ltd., respectively, on a sheet of paper having a thickness of 0.8 mm by using an applicator manufactured by Nodosone Co. Ltd., to form a bookbinding cover of the present invention used for a size A4 book. The thicknesses of the first layer 4*a* and the second layer 4*b*** were 1.0 mm and 0.5 mm, respectively. The sheet of paper used had a front cover a rear cover and a back plate, all of which were connected to each other to form a sheet.

A bundle of 50 sheets of the paper shown in Table 1 was bonded to the adhesive layer of the bookbinding cover formed to bind a book. The bundle of sheets was placed on the adhesive layer and bonded thereto by applying the back plate to a hot plate at a surface temperature of 130° C. for 20 seconds.

As a result, any bundle of bookbinding cover was bonded to the adhesive layer with sufficient strength about 25 seconds after the heating, and thus the bookbinding cover could be put into practical use. (When a sheet was pulled with the hand, it was not separated from the adhesive layer, and when a sheet was forcibly pulled, it was torn.)

TABLE 1

| Paper | Example 1 | Example 2 | Example 3 | Example 4 | Example 5 |
|---|---|---|---|---|---|
| Thickness (mm) | 0.089 | 0.086 | 0.082 | 0.105 | 0.086 |
| Density (g/cm$^3$) | 0.737 | 0.755 | 0.773 | 0.744 | 0.767 |
| Smoothness (second) | 25 | 34 | 46 | 25 | 41 |

EXAMPLES 6–10

The first layer **4*a* and the second layer 4*b*, both of which are shown in FIG. 1, were formed by applying polyester hot-melt adhesive PES-120H (softening point, 120° C.) manufactured by Toa Synthetic Chemical Industry Co. Ltd., and the same hot-melt adhesive K2982 as that used in Example 1, respectively, on a sheet of paper having a thickness of 0.8 mm by using an applicator manufactured by Nodosone Co. Ltd., to form a bookbinding cover of the present invention for a A4 size of book. The thickness of the first layer 4*a* and the second layer 4*b*** were 0.7 mm and 0.3 mm, respectively. The sheet of paper used had a front cover a, rear cover and a back plate, all of which were connected to each other to form a sheet.

A bundle of 50 sheets of the paper shown in Table 2 was bonded to the adhesive layer of the bookbinding cover formed to bind a book. The bundle of sheets was placed on the adhesive layer and bonded thereto by applying the back plate to a hot plate at a surface temperature of 130° C. for 30 seconds.

As a result, any bundle of sheets was bonded to the adhesive layer with sufficient strength about 25 seconds after the heating, and thus the bookbinding cover could be put into practical use.

TABLE 2

| Paper | Example 6 | Example 7 | Example 8 | Example 9 | Example 10 |
|---|---|---|---|---|---|
| Thickness (mm) | 0.089 | 0.086 | 0.082 | 0.105 | 0.086 |
| Density (g/cm$^3$) | 0.737 | 0.755 | 0.773 | 0.744 | 0.767 |
| Smoothness (second) | 25 | 34 | 46 | 25 | 41 |

EXAMPLE 11

An adhesive layer in a triple layer structure was formed on the back plate portion of a sheet of paper having a thickness of 0.8 mm (a front cover, a rear cover and a back plate were connected to form a bookbinding cover to form a bookbinding cover of the present invention used for a size 4A book. The adhesive layer in a triple layer structure was formed by applying to the back plate the same adhesive PES-120H as that used in Example 6, the same hot-melt adhesive bond BC603 as that used in Example 1 and the same adhesive K2982 as that used in Example 1 in this order from the back plate side. The thicknesses of the adhesive layers formed were 0.7 mm, 0.5 mm and 0.3 mm in the order from the back plate.

A bundle of 50 sheets of the same paper as that used in Example 1 was bonded to the bookbinding cover to bind a book. The bundle of paper was bonded by the same method as that employed in Example 1.

As a result, the bundle of the paper sheets was bonded to the adhesive layer with sufficient strength about 25 seconds after heating, and thus the bookbinding cover could be put into practical use.

COMPARATIVE EXAMPLE

The same hot-melt adhesive BC603 as that used in Example 1 was applied in a thickness of 1.5 mm to the back plate portion of a sheet of paper having a thickness of 0.8 mm (a front cover, a rear cover and a back plate were connected to form a bookbinding cover to form a bookbinding cover used for a size A4 book.

A bundle of 50 sheets of the same paper as that used in Example 1 was bonded to the adhesive layer to bind a book by the same method as that employed in Example 1.

As a result, the time required for binding a book which could be handled after heating was about 45 seconds.

What is claimed is:

1. A bookbinding cover, comprising:

a bookbinding sheet having a front cover, a rear cover and a back plate, with said back plate having an inside portion and an outside portion and being connected to said front cover and said rear cover; and a hot-melt adhesive applied to said inside portion of said back plate, with said adhesive having at least first and second layers successively applied to said back plate, wherein each said layer has a softening point and the softening point of each said successive layer decreases as the distance of each layer from said back plate increases.

2. A bookbinding cover according to claim 1, wherein the highest softening point of said layers in said adhesive is at least 100° C., and the lowest softening point of said layers in said adhesive is between 50° and 90° C.

3. A bookbinding cover according to claim 2, wherein the highest softening point of said layers in said adhesive is between 100° C. and 200° C.

4. A bookbinding cover according to claim 1, wherein a thickness of said layers decreases with a increase in distance from said back plate.

5. A bookbinding cover according to claim 1, wherein said adhesive has a double layer structure comprising a first adhesive layer disposed adjacent to said back plate and a second adhesive layer.

6. A bookbinding cover according to claim 5, wherein the softening point of said first adhesive layer is at least 100° C., and the softening point of said second adhesive layer is between 50° and 90° C.

7. A bookbinding cover according to claim 6, wherein the softening point of said first adhesive layer is 100° to 200° C.

8. A bookbinding cover according to claim 5, wherein said second adhesive layer has a thickness which is smaller than that of said first adhesive layer.

9. A bookbinding method for forming a book from a bookbinding cover having a front cover, a rear cover and a back plate, comprising the steps of:

applying a first adhesive layer to an inside portion of the back plate, with the first adhesive layer having a first softening point;

applying a second adhesive layer on the first adhesive layer, with the second adhesive layer having a second softening point which is lower than the first softening point;

placing a plurality of page-forming sheets in contact with the second adhesive layer;

heating the back plate to a temperature which softens the second adhesive layer but not the first adhesive layer; and pressing the plurality of sheets into the softened second adhesive layer.

10. A bookbinding method according to claim 9, further comprising the steps of using sheets of paper with a density of 0.75±0.150 g/cm$^3$.

11. A bookbinding method according to claim 9, further comprising the steps of using sheets of paper with a smoothness of 10 to 100 seconds.

* * * * *

UNITED STATES PATENT AND TRADEMARK OFFICE

CERTIFICATE OF CORRECTION

PATENT NO. : 5,156,510

DATED : October 20, 1992

INVENTOR(S) : Haruo Uehara

It is certified that error appears in the above-identified patent and that said Letters Patent is hereby corrected as shown below:

COLUMN 5:

Line 36, "layer" should read --layer 4b,--.
Line 37, "layer 4b." should read --layer.--.

COLUMN 6:

Line 38, "bookbinding cover" should read --sheets--.
Line 68, "front cover a," should read --front cover, a--.
Line 29, after "cover" insert a --,--.

COLUMN 7:

Line 29, "cover" should read --cover)--.
Line 53, "cover" should read --cover)--.

Signed and Sealed this

Twenty-first Day of December, 1993

*Attest:*

*Attesting Officer*

BRUCE LEHMAN

*Commissioner of Patents and Trademarks*